United States Patent [19]

Hall

[11] Patent Number: 5,052,582

[45] Date of Patent: Oct. 1, 1991

[54] CONTAINMENT BASIN ASSEMBLY FOR CHEMICAL STORAGE TANK

[75] Inventor: Christopher C. Hall, Gwynedd Valley, Pa.

[73] Assignee: Betz Laboratories, Inc., Trevose, Pa.

[21] Appl. No.: 609,568

[22] Filed: Nov. 5, 1990

[51] Int. Cl.[5] ..... F04B 45/02

[52] U.S. Cl. ..... 220/571; 220/85 H; 137/312

[58] Field of Search ..... 220/571, 23.83, 23.86, 220/85 H, 85 S, DIG. 6; 137/150, 312

[56] References Cited

U.S. PATENT DOCUMENTS 4,488,500 12/1984 Mototsuna ..... 220/571
4,733,790 3/1988 Stein ..... 220/571
4,765,360 8/1988 Baird ..... 137/312
4,862,909 9/1989 Kim ..... 220/571

*Primary Examiner*—Joseph Man-Fu Moy
*Attorney, Agent, or Firm*—Alexander D. Ricci; Bruce E. Peacock

[57] ABSTRACT

A containment basin assembly for receipt of a tank of liquid chemical or the like is disclosed wherein a mounting stand for the tank is integral with the basin and positioned off-center therein. A bucket can be conveniently located underneath the manifold valve or other liquid dispensing conduit connected to the tank so that spilled or leaking liquid from the valve or conduit can be easily removed for proper disposal.

11 Claims, 2 Drawing Sheets

CONTAINMENT BASIN ASSEMBLY FOR CHEMICAL STORAGE TANK

FIELD OF THE INVENTION

The present invention relates to an integral tank stand and containment basin used to support a storage tank containing hazardous and non-hazardous chemicals.

BACKGROUND OF THE INVENTION

Several types of draining pans and liquid containers are known in the art. U.S. Pat. No. 4,862,909, issued to Kim, discloses a drainage pan, including container support members, for liquid waste containers which includes a Z-bar suction pump for draining the liquid waste leaked from a liquid waste container into a drainage pipe so as to prevent the liquid waste from contaminating the ground.

U.S. Pat. No. 4,765,360, issued to Baird, discloses a water heater leak collector wherein the heater may be positioned on a stand. A drain line communicating with the stand carries away leaking water.

Neither of the prior art patents noted above is concerned with the problem of providing a readily transportable basin and mounting stand for a chemical tank wherein a pan or the like can be positioned in the basin to catch leaks and the like emanating from conduits or valves connected to the tank. Moreover, neither of these patents provides for an integral mounting stand-basin assembly.

Accordingly, it is an object of the present invention to provide an integral tank stand and containment basin used to support a liquid chemical storage tank.

A further object of the present invention is to provide a stand and tank assembly having a rounded bottom surface so that the assembly can be manually rolled to the desired end use location.

Another object of the present invention is to provide cross-linked polyethylene tanks that are semi-transparent for easy reading of chemical levels.

A still further object of the present invention is to provide a containment basin/stand combination that is rugged, puncture proof and light weight.

DETAILED DESCRIPTION OF THE INVENTION

Figure 2:
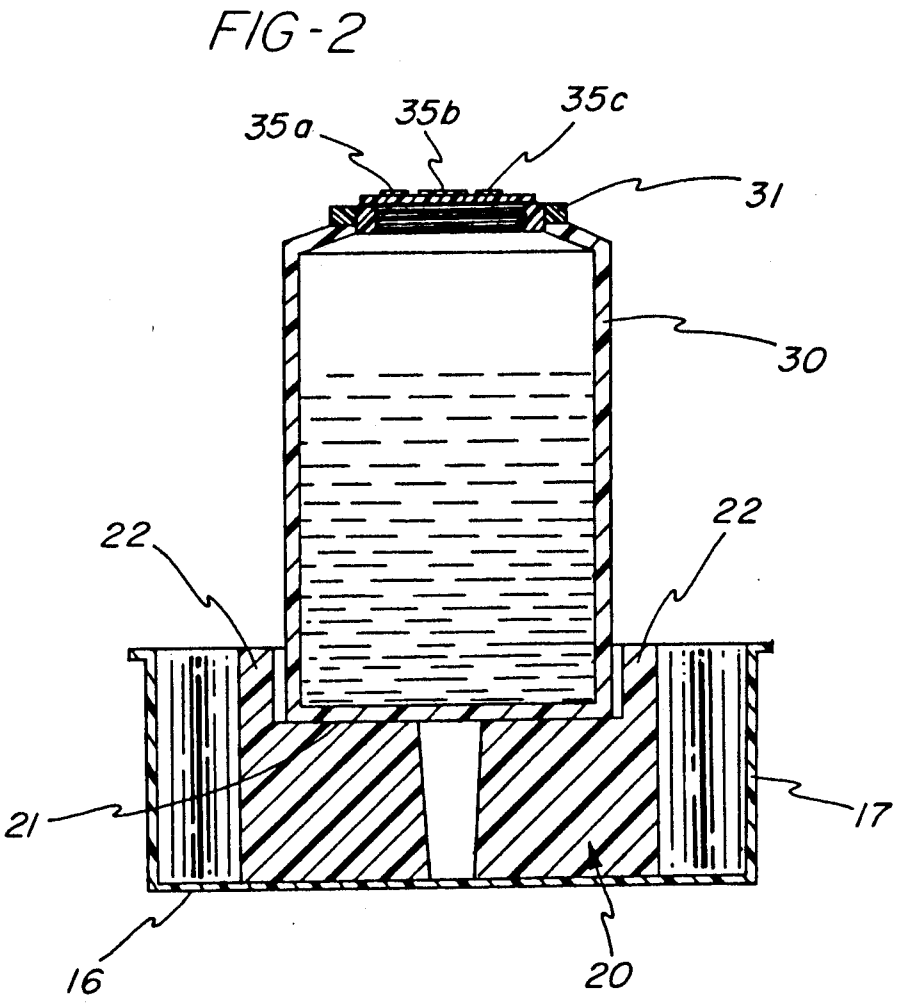
FIG. 2 is a sectional view of the tank, stand and basin assembly taken along the lines and arrows 2—2 of FIG. 1.
Figure 1:
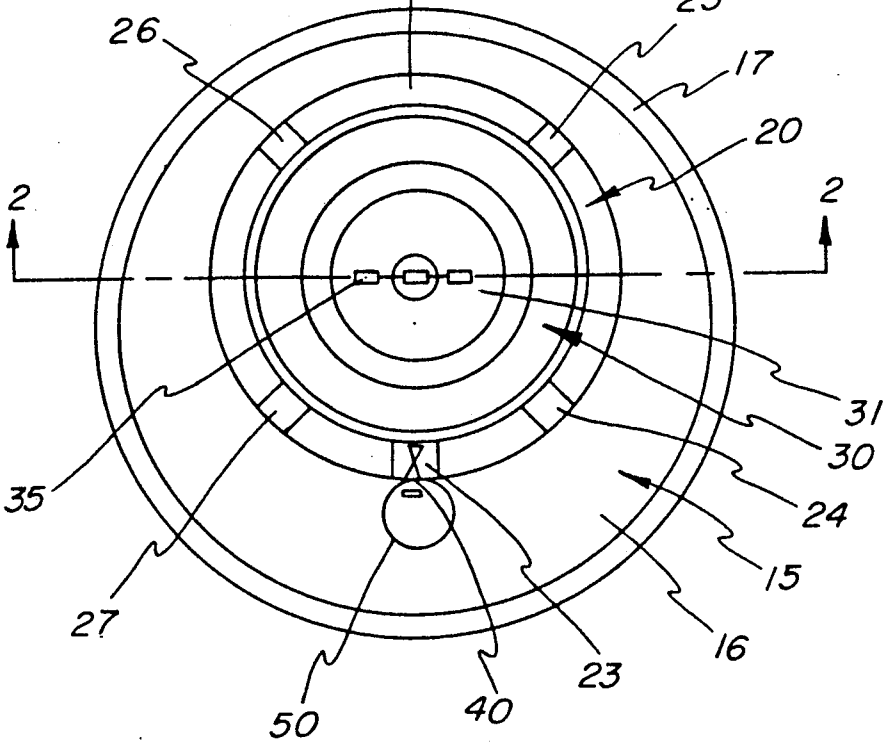
FIG. 1 is a plan view showing a chemical tank in place in the stand. The stand and tank are disposed off-center with respect to the integral overflow basin.

Referring now specifically to FIGS. 1 and 2, there is shown a containment basin assembly for a chemical storage tank or the like containing liquid chemical product. A tank 30 is positioned on top of a mounting means, such as a stand 20. The stand 20 is positioned in off-center relationship with respect to the basin 15. The stand 20 is preferably integrally formed with the bottom surface 16 of basin. Both the stand 20 and basin may be composed of transparent crosslinked polyethylene or transparent propylene.

The bottom surface 16 of basin 15 is generally circular in shape with the stand 20 being therefore located off-center with respect to the center of circular bottom surface 16. The stand 20 comprises a generally planar top surface area 21 which is surrounded by upstanding peripheral walls 22 which together define a recessed landing for reception of chemical tank 30 therein (see also FIG. 3). Chemical tank 30 comprises screw-on lid member 31 and vent openings 35*a–c*. Slots 23, 24, 25 and 26 are formed in the upstanding peripheral walls 22 of stand 20 so as to receive a valve 40 or other conduit connected to tank 30. Beneath the connection of valve 40 or conduit to tank 30 is disposed a bucket or the like 50 so that leaking liquid from the valve or conduit drops therein. Any other means for containing liquid spill other than a drain pan may be utilized.

Figure 3:
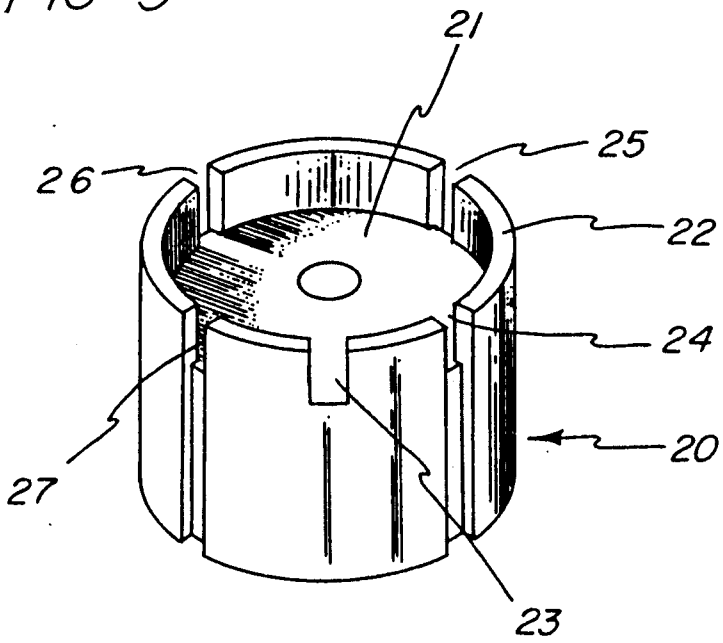
FIG. 3 is an elevational view of the tank stand by itself.

Turning now to FIG. 3, there is shown in elevation a view of the stand 20 itself. Here, the upstanding peripheral walls 22 may clearly be shown in cooperation with planar top surface 21. Together, these members form a recessed landing for reception of the desired chemical storage tank therein.

Figure 4:
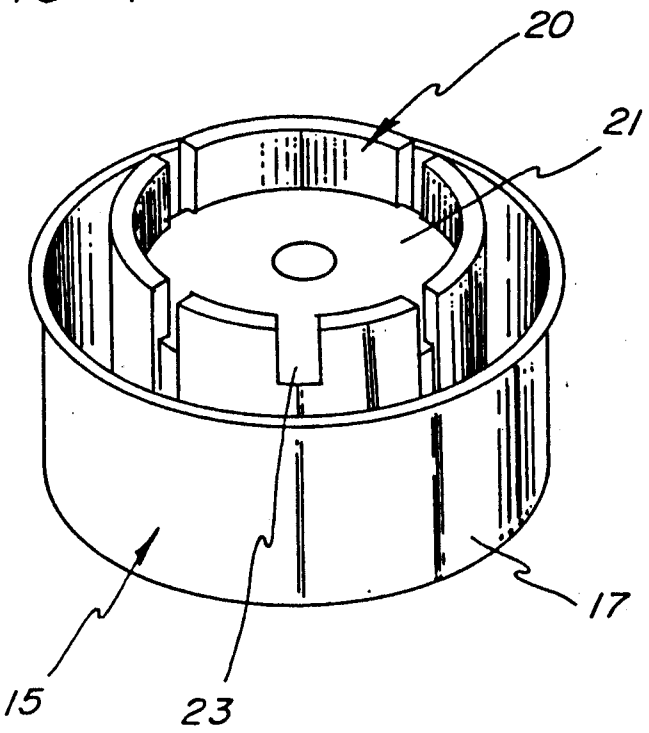
FIG. 4 is an elevational view of the integral stand and containment basin assembly of the invention.

FIG. 4 depicts the basin 15 and integral stand 20 positioned off-center therein. Basin 15 comprises circular upstanding walls 17 surrounding bottom surface 16 (not shown in FIG. 4). The circular design of the basin 15 allows for convenience in moving the basin and stand assembly to the desired end-use location. The stand-basin assembly can be turned on its side and simply rolled to its final destination and the desired chemical tank can then be inserted in the stand 20 on top of planar surface 21 as shown most clearly in FIG. 2.

Although this invention has been described with respect to preferred embodiments thereof, it will be appreciated that a wide variety of equivalents may be substituted for those specific elements shown and described herein, all without departing from the spirit and scope of the invention as defined in the appended claims.

What I claim is:

1. A containment basin assembly for a tank containing liquid chemical product comprising, in combination:

a containment basin having a bottom surface and an upstanding wall member surrounding and extending from said bottom surface, and mounting means integral with said bottom surface and extending upwardly therefrom adapted to receive said tank, said mounting means being located off-center with respect to said bottom surface.

2. Assembly as recited in claim 1 wherein said bottom surface is generally circular in shape.

3. Assembly as recited in claim 1 wherein said basin and said mounting means are composed of molded plastic.

4. Assembly as recited in claim 1 wherein said plastic comprises cross-linked polyethylene.

5. Assembly as recited in claim 1 wherein said plastic comprises polypropylene.

6. Assembly as recited in claim 1 wherein said mounting means comprises a generally planar top surface spaced above said bottom surface of said basin, said mounting means further including peripheral walls surrounding and extending upwardly from said top surface to provide, with said top surface, a recessed stand for mounting a tank therein.

7. Assembly as recited in claim 6 wherein said top surface is generally circular in shape and said peripheral walls define a circular ridge around said top surface.

8. Assembly as recited in claim 7 wherein said peripheral walls have at least one slot formed therein defining a channel adapted for reception of a conduit connected to said tank.

9. Assembly as recited in claim 6 further comprising a tank positioned in said stand.

10. Assembly as recited in claim 9 further comprising valve means connected to said tank and liquid spill containment means disposed underneath said valve means on said bottom surface.

11. Assembly as recited in claim 10 wherein said liquid spill containment means comprises a drain pan.

* * * * *